United States Patent [19]

Schultz

[11] Patent Number: 4,690,311

[45] Date of Patent: Sep. 1, 1987

[54] BOTTLE WITH FINGER PIECES

[76] Inventor: Abraham Y. Schultz, 1233 Guelbreth La., Creve Coeur, Mo. 63141

[21] Appl. No.: 858,889

[22] Filed: Apr. 25, 1986

Related U.S. Application Data

[63] Continuation of Ser. No. 369,368, Apr. 19, 1982, abandoned.

[51] Int. Cl.[4] ..... G01F 11/02

[52] U.S. Cl. ..... 222/324; 215/100 A; D9/381; D23/15

[58] Field of Search ..... 222/321, 323, 324, 470, 222/471; 220/94 A; 215/100 A; 239/375, 378; D9/380, 381, 378, 379, 382; D23/14, 15

[56] References Cited

U.S. PATENT DOCUMENTS

| | | | |
|---|---|---|---|
| D. 41,855 | 10/1911 | Sutherland | D9/380 |
| D. 87,987 | 10/1932 | Wade | D9/380 |
| D. 108,599 | 2/1938 | Bernhardt | D23/15 |
| D. 128,604 | 8/1941 | Shiplett | D9/380 |
| D. 202,382 | 9/1965 | Heisler et al. | D9/380 |
| 2,519,640 | 8/1950 | Echols et al. | 222/321 |
| 2,606,699 | 8/1952 | Andricks | 222/482 X |

*Primary Examiner*—F. J. Bartuska

*Attorney, Agent, or Firm*—Rogers, Howell, Moore & Haferkamp

[57] ABSTRACT

A bottle, preferably of plastic, having integrally formed finger pieces projecting upwardly and transversely of the shoulder of the bottle, but preferably terminating within the lateral limits of the bottle itself, and being able to be grasped between the thumb and a finger, or otherwise grapsed, for holding, the finger pieces being separate or clear of the cap so that different kinds of caps or closures can be used.

3 Claims, 4 Drawing Figures

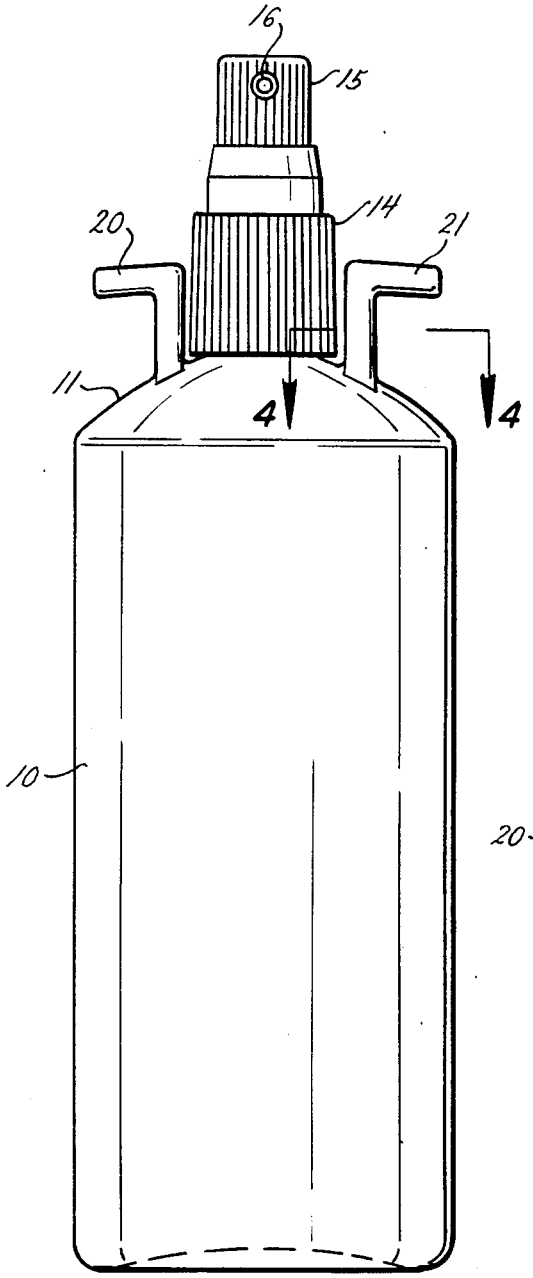
FIG. 1.
FIG. 4.
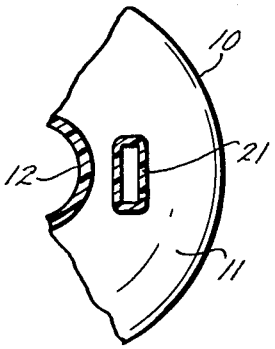
FIG. 3.
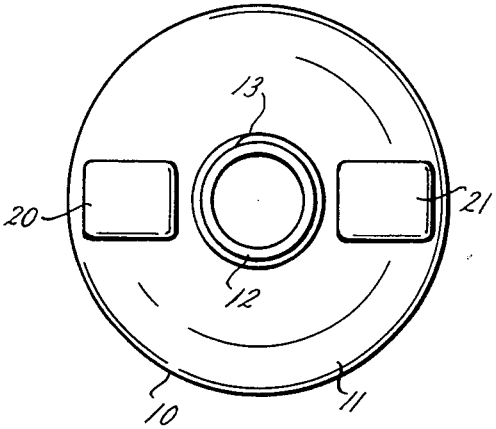
FIG. 2.
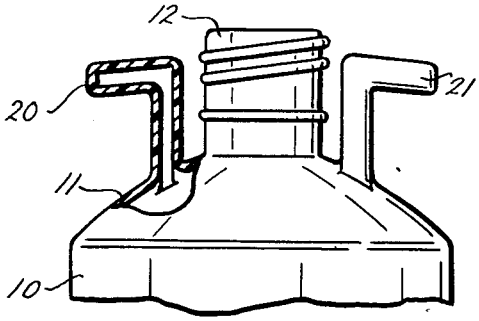

BOTTLE WITH FINGER PIECES

This is a continuation of application Ser. No. 369,368, filed on Apr. 19, 1982, now abandoned.

THE PRIOR ART AND OBJECTS OF THE INVENTION

Heretofore containers have been made with finger pieces. The Wade U.S. Pat. Des. No. 87,987 shows a bottle with finger pieces projecting from the neck. It is an object of the present invention, however, to have the finger pieces more satisfactorily and comfortably located as projecting upwardly and transversely to the shoulder of the bottle rather than only laterally from the neck or cap.

Somewhat unrelated devices include those shown in the Andricks U.S. Pat. No. 2,606,699 where finger pieces extend laterally from a cover and extend well beyond the main body of the container. It is, therefore, an object of the present invention to have a bottle with integrally formed finger pieces extending upwardly and transversely so that they will enable the bottle to be grasped and clamped between, for example, the thumb and third finger, and which preferably do not project beyond the lateral limits of the bottle.

Other prior art may have had a collar around the top of the bottle rather than two separate individual finger pieces. It is an object of the present invention to overcome disadvantages in the collar arrangement which include overcoming the awkwardness of such an arrangement with respect to fitting and removing the cap, and also the difficulty of maintaining the part within the collar clean and sanitary.

Another advantage of the present arrangement is that the delivery orifice may be confined to a specific vertical path, such as midway between the finger pieces, thereby reducing the chance that the user might spray the liquid into his own face.

Other objects will appear from the description to follow.

IN THE DRAWING

FIG. 1 is a side elevation of a bottle incorporating the present invention;

FIG. 2 is a view of the top part of that bottle partly in section and with the cap removed;

FIG. 3 is a top plan view of the bottle shown in FIG. 1; and

FIG. 4 is a section on the line 4—4 of FIG. 1.

DESCRIPTION OF THE PREFERRED EMBODIMENT

The bottle 10 is preferably made of plastic but could be made of any moldable, castable or other material appropriate to the use. Typically this can be a moldable thermoplastic material such as polyethylene. The bottle, as illustrated, is round and has a rounded shoulder portion 11 leading up to a neck 12, although this shape of the shoulder may be varied. In this particular illustration, the neck 12 is shown as having threads 13 to receive a cap 14 of the type having a push button 15 that dispenses liquid out of port 16. Other types of neck and cap arrangements could be used. As will appear, it is contemplated that the button 15 may be confined to a single vertical path.

The particular features of the invention include the two finger pieces 20 and 21. These preferably are molded in the material of the bottle as shown in FIG. 2. It is seen that they project from the shoulder 11 of the bottle and have components that extend upwardly and transversely therefrom. They are spaced apart from each other by a distance to be included comfortably between the thumb and other fingers, as will appear. Their shape is such as to enable the fingers engaging them to support the bottle of liquid, a function primarily of their transverse portions, but they do not need to extend beyond the lateral limits of the bottle, making the bottle fit more economically into cartons, shelves, etc. Their corner edges in cross-section are preferably rounded so as to be comfortable. By having two separate finger pieces instead of a complete, circular collar, a bottle is produced that is neater and more sanitary, as well as easier to assemble with its cap. Having the finger pieces integral with the bottle itself, they are stronger.

In Use

In use, the bottle may be grasped in a number of different ways by the user. Typically, with his palm downward, he will put his thumb and middle finger under the two members 20 and 21 and his forefinger atop the push button (if one is used) 15 which can then be depressed to expel liquid from the bottle out the port 16. Substantially the same operation can be performed if he uses the thumb under one finger piece such as 20, and one of the other third or fourth fingers under the finger piece 21.

Another way of operating that can be performed with this bottle is with the hand palm up. In this, the operator may hook two fingers under the finger pieces 20 and 21 and depress the button 15 with his thumb. Alternately, with his hand around the body of the bottle 10, the operator may hook one finger under one of the finger pieces 20 or 21 while he depresses the push button with his forefinger.

The foregoing arrangement has an advantage over putting the finger pieces as a part of the cap as, for example, in U.S. Pat. Des. No. 128,604 or U.S. Pat. Des. No. 87,987. It is likewise clearly superior to the arrangement in U.S. Pat. No. 2,606,699 where the finger pieces, in a different kind of a dispenser, are not parts of the shoulder of the container but project outwardly where they are very inconvenient. The present arrangement wherein the finger pieces are on the bottle, permits the bottle to be used with different kinds of dispenser cap assemblies.

There are various changes and modifications which may be made to applicant's invention as would be apparent to those skilled in the art. However, any of these changes or modifications are included in the teaching of applicant's disclosure and he intends that his invention be limited only by the scope of the claims as appended hereto.

What I claim is:

1. A bottle of a size to be grasped in one hand having finger pieces thereon including: a shoulder on the upper end of the bottle from the center of which projects a neck, the neck extending upwardly at a sharp angle to the shoulder so that the bottom of the neck merges with the shoulder in a line of demarcation around the neck, two free-standing finger pieces of similar shape integrally found with and individually and separately projecting upwardly from opposite sides of the shoulder and transversely to the shoulder of the bottle, the base portions of the finger pieces being integrally formed with the shoulder and extending upwardly from the shoulder at points outside and spaced away from the neck so that the entire lengths of the upwardly projecting portions of the finger pieces are spaced outwardly and away from the neck to provide a space between each upwardly extending portion and the neck, the finger pieces projecting upwardly and transversely to be engageable by the fingers of a user, and terminating outwardly in outer ends so that the transverse distance from the base of each finger piece to the end of each finger piece lies substantially within the lateral limits of the bottle, the outer ends of the finger pieces being disconnected from and spaced above and free from the shoulder of the bottle to enable a pair of digits of a hand to move from each side of the bottle so that each said digit can engage the upwardly extending portion of each finger piece and engage the undersides of the transverse portions of the finger pieces, to allow a third digit of the same hand to rest atop a cap to press downwardly thereagainst.

2. The bottle of claim 1, wherein the finger pieces extend upwardly substantially parallel to the axis of the bottle, and then radially transversely, and wherein the finger pieces are of substantially identical size and shape.

3. A bottle and cap assembly comprising:

(a) a cap having a downwardly extending wall, the cap wall having a bottom end;

(b) a bottle having an upper end, a shoulder on the upper end of the bottle, a neck extending upwardly at a sharp angle to the shoulder so that the bottom of the neck merges with the shoulder in a line of demarcation around the neck, the neck projecting from approximately the center of the shoulder, two free-standing finger pieces of similar shape integrally formed with an individually and separately projecting upwardly from opposite sides of the shoulder and transversely to the shoulder, the finger pieces having their bottom portions integrally formed with the shoulder and extending upwardly from the shoulder at points outside and spaced away from the neck so that the entire length of the upwardly projecting portions of the finger pieces are spaced outwardly and away from the neck to provide a space between each upwardly extending portion and the neck to enable the cap to be fitted over and around the neck so that the wall of the cap fits in each of the two spaces between the neck and each of the two finger pieces, with the bottom end of the cap resting substantially near the shoulder, the finger pieces projecting upwardly and transversely to be engageable by the hand digits of a user, and terminating outwardly in outer ends so that the transverse distance from the base of each finger piece to the end of each finger piece lies substantially within the lateral limits of the bottle, the outer ends of the finger pieces being disconnected from and spaced above and free from the shoulder of the bottle to enable a pair of digits of a hand to move from each side of the bottle so that each said digit can engage the upwardly extending portion of each finger piece and engage the undersides of the transverse portions of the finger pieces, to allow a third digit of the same hand to rest atop the cap to press downwardly thereagainst.

* * * * *

UNITED STATES PATENT OFFICE

CERTIFICATE OF CORRECTION

Patent No. 4,690,311 Dated September 1, 1987

Inventor(s) Abraham Y. Schultz

It is certified that error appears in the above-identified patent and that said Letters Patent are hereby corrected as shown below:

Column 2, line 64, change "found" to --formed--.

Column 4, line 2, change "an" to --and--.

Signed and Sealed this

Twelfth Day of January, 1988

*Attest:*

DONALD J. QUIGG

*Attesting Officer*

*Commissioner of Patents and Trademarks*